US009123205B2

(12) United States Patent
Weingardt et al.

(10) Patent No.: US 9,123,205 B2
(45) Date of Patent: Sep. 1, 2015

(54) ONLINE GAMING TOURNAMENT SYSTEM HAVING PRIZES FOR PLAYERS IN WINNING CATEGORIES AND METHOD THEREFOR

(71) Applicant: GAMING GRIDS, INC., Las Vegas, NV (US)

(72) Inventors: Gary Weingardt, Las Vegas, NV (US); Travis N. Howle, La Center, KY (US); Dana Garvey, Redondo Beach, CA (US); Robert E. Connolly, III, Magalia, CA (US)

(73) Assignee: GAMING GRIDS, LLC, Las Vegas, NV (US)

( * ) Notice: Subject to any disclaimer, the term of this patent is extended or adjusted under 35 U.S.C. 154(b) by 0 days.

(21) Appl. No.: 14/290,793

(22) Filed: May 29, 2014

(65) Prior Publication Data

US 2014/0357350 A1 Dec. 4, 2014

Related U.S. Application Data

(60) Provisional application No. 61/831,045, filed on Jun. 4, 2013.

(51) Int. Cl.
*G07F 17/32* (2006.01)
*A63F 13/12* (2006.01)

(52) U.S. Cl.
CPC ..... *G07F 17/3258* (2013.01); *G07F 17/3276* (2013.01)

(58) Field of Classification Search
CPC . G07F 17/32; G07F 17/3258; G07F 17/3288; G07F 17/3276; A63F 13/12; A63F 2300/531; A63F 2300/556
USPC ..... 463/27, 28, 42
See application file for complete search history.

(56) References Cited

U.S. PATENT DOCUMENTS

| | | | | |
|---|---|---|---|---|
| 6,093,100 | A | 7/2000 | Singer et al. | |
| 8,038,535 | B2 * | 10/2011 | Jensen | 463/42 |
| 8,360,844 | B2 * | 1/2013 | Schwartz et al. | 463/17 |
| 8,663,012 | B2 | 3/2014 | Weingardt | |
| 2006/0247060 | A1 | 11/2006 | Hanson et al. | |
| 2006/0287106 | A1 * | 12/2006 | Jensen | 463/42 |
| 2008/0009344 | A1 | 1/2008 | Graham et al. | |
| 2009/0117962 | A1 | 5/2009 | Flipour et al. | |
| 2009/0170583 | A1 | 7/2009 | Moody | |
| 2011/0057391 | A1 * | 3/2011 | Wong et al. | 273/292 |
| 2011/0223983 | A1 * | 9/2011 | Schwartz et al. | 463/17 |
| 2011/0319175 | A1 * | 12/2011 | Jensen | 463/42 |
| 2014/0141868 | A1 | 5/2014 | Kelly et al. | |

* cited by examiner

*Primary Examiner* — Pierre E Elisca
(74) *Attorney, Agent, or Firm* — Weiss & Moy, P.C.; Jeffrey D. Moy; Veronica-Adele R. Cao

(57) ABSTRACT

Disclosed herein is a video gaming system having a server and including a processor for executing computer program instructions and having a memory coupled to the processor for storing the computer program instructions, the programming instructions comprising: establishing at least one online video gaming tournament; accepting participants entry into the online video gaming tournament; establishing a tournament pool, which includes a system of rewards and wherein a percentage of rewards is distributed as winnings; distribution of winnings upon completion of the video gaming tournament the distribution being based upon the player's statistical game performance.

38 Claims, 10 Drawing Sheets

ONLINE GAMING TOURNAMENT SYSTEM HAVING PRIZES FOR PLAYERS IN WINNING CATEGORIES AND METHOD THEREFOR

RELATED APPLICATIONS

The present patent application claims the benefit of U.S. Provisional Application No. 61/831,045, filed Jun. 4, 2013, entitled "GamingGrids.com Tournaments" in the name of the same inventors, and which is incorporated herein by reference in its entirety. The present patent application is further related to U.S. Pat. No. 8,663,012, entitled "Networked, Electronic Game Tournament Method and System, in the name of Gary Weingardt, and is hereby specifically incorporated herewith by reference for all purposes and in all sections of the specification.

TECHNICAL FIELD

This invention relates generally to an online video gaming system, and more particularly to a video online gaming tournament that utilizes groups of players receiving prizes in their winning category(s), progressive jackpots and other features designed to increase the attractiveness and excitement of the game to the players

BACKGROUND

With the advent of wired and wireless communication networks (i.e., Internet), online computer gaming has become increasing popular with many people. Online services may allow for video game players to play against other players from all over the world. With such a large pool of potential players, there is a correspondingly large range of player abilities, ranging from the first-time or occasional player to the daily, devoted fan and even on to the ranks of professional video game players.

Some organized competitions, such as tournaments, may attempt to match players of equal skill. These online multi-player tournaments have typically been in a "Bracket" or tree diagram or Ladder format which has limited availability consisting of the top players or teams. Because of this, many people who may wish to participate opt not to as these players may not qualify or may feel that they are not "good enough" to participate. Further, these online multi-player tournaments generally only award the winning players or teams. Some consolation prizes may be awarded. However, the vast majority of players generally have no realistic chance of winning any prize. As one can imagine, the really large global tournaments, under the present system, provide the average player with a very small opportunity of success. In fact, the most lucrative market currently, is the Massively Multiplayer Online game tournament or MMO. These MMO tournaments attract huge gamer interest, but also presently provide little opportunity for the average player to be rewarded. Additionally, the Massively Multiplayer Online Role-Playing Game tournaments (MMORPG) require huge amounts of computer Attention, time and storage space. There is no presently known computer system, including hardware and software capable of handling the statistics required and thus, the vast majority of players are left without proper customer service, creating a significant issue in the industry. This is has been long felt and has been present since the inception of such games.

Therefore, it is desirable to provide a new system and method that overcome the above issues. The new system and method should, preferably, be open to the massive public audiences (MMO) with rewards being presented to the majority of participants and at the same time rewarding the few outstanding players with progressive jackpots as well as other rewards systems. What is also needed to overcome existing issues is the computing ability to handle the massive amount of statistics, for example, present in an MMORPG.

SUMMARY OF THE INVENTION

This summary is provided to introduce a selection of concepts of the present invention in a simplified form that are further described in detail below in the DETAILED DESCRIPTION OF THE INVENTION. This summary is not intended to identify each and every key feature of the invention, which remains the exclusive purview of claims, nor is the Summary intended to be used as an aid in determining the scope of the claimed subject matter.

In accordance with one exemplary embodiment of the present application, a video gaming system is disclosed. The video gaming system has a server having a processor for executing program instructions and a memory coupled to the processor for storing the program instructions, the programming instructions comprising: establishing at least one online video gaming tournament; accepting participants entry into the online video gaming tournament; establishing a tournament pool, which includes a system of rewards, both monetary and non-monetary, a percentage of the rewards is distributed as winnings; distribution of the winnings upon completion of the video gaming tournament. Additionally, this embodiment uses a statistical server to keep track of gamer information including results of particular battles or engagements as well as skills achieved and levels earned as well as the result of each contest and the opponents relative strength.

In accordance with another exemplary embodiment of the present application, an online video gaming tournament system is disclosed. In this exemplary embodiment, the online video gaming tournament system has a plurality of video gaming servers for hosting a plurality of online video gaming tournaments, wherein the plurality of online video gaming tournaments comprise at least one global online video gaming tournaments and at least one regional online video gaming tournaments. A statistical server is coupled to the plurality of video gaming servers having a processor for executing program instructions and a memory coupled to the processor for storing the program instructions, the programming instructions comprising: accepting of entry fee by participants in the online video gaming tournaments; establishing a tournament pool, wherein a percentage of monies from the entry fee collected is distributed as winnings; establishing a dynamic participant ranking grid, wherein a position of the participant on the dynamic participant ranking grid moves during and after the online video gaming tournaments, wherein performance of the participant in-game and skill ranking differential between at least two participants determine movement on the dynamic participant ranking grid; establishing at least one progressive jackpot, the at least one progressive jackpot is awarded based on skill based on one of: achievements in the online video gaming tournament or combinations of skill sets or sequential skills or skill sets performed in the online video gaming tournament; and payment of winnings after the video gaming tournaments have expired.

In accordance with another exemplary embodiment of the present application, an online video gaming tournament system is disclosed. The online video gaming tournament system has a plurality of video gaming servers for hosting a plurality of online video gaming tournaments, wherein the plurality of online video gaming tournaments comprise at least one global online video gaming tournaments and at least one regional online video gaming tournaments. A statistical server is coupled to the plurality of video gaming servers having a processor for executing program instructions and a memory coupled to the processor for storing the program instructions, the programming instructions comprising: accepting of entry fee by participants in the online video gaming tournaments; establishing a tournament pool, wherein a percentage of monies from the entry fee collected is distributed as winnings and a percentage of monies from the entry fee collected is distributed to predetermined non-winning participants; establishing a dynamic participant multi-level, multi-tier ranking grid, wherein a position of the participant on the dynamic participant ranking grid moves during and after the online video gaming tournaments, wherein performance of the participant in-game and skill ranking differential between at least two participants determine movement on the dynamic participant ranking grid; establishing a plurality of progressive jackpots, wherein at least one of the plurality of progressive jackpots is awarded based on skill based on one of: achievements in the online video gaming tournament or combinations of skill sets or sequential skills or skill sets performed in the online video gaming tournament; establishing virtual participant bank accounts, payment of winnings distributed sand contained within the virtual participant bank account of the winning participants: and payment of winnings after the video gaining tournaments have expired, payment of winnings based on statistical game performance.

In accordance with another exemplary embodiment of the present application, an online video gaming tournament system is disclosed, which includes a server having a processor for executing program instructions and a memory coupled to the processor for storing the program instructions. The programming instructions include establishing at least one online video gaming tournament, accepting an entry fee by participants in the online video gaining tournament; establishing a tournament pool. In this exemplary embodiment, a percentage of monies from the entry fee collected are distributed as winnings; and there exists at least one progressive jackpot. The one progressive jackpot is awarded based on skill based achievements In accordance with another exemplary embodiment of the present application, an online video gaining tournament system is disclosed. The video gaming system has a server having a processor for executing program instructions and a memory coupled to the processor for storing the program instructions, the programming instructions comprising: establishing at least one online video gaming tournament; accepting of entry fee by participants in the online video gaming tournament: establishing a tournament pool, wherein a percentage of monies from the entry fee collected is distributed as winnings; and establishing a consolation prize system to pay non-winning participants a percentage of monies from the entry fee collected.

It will be appreciated that the scope of the invention is not limited to games requiring an entry fee in any of the above or below described exemplary embodiments. Rather, the invention covers both fee and non-fee games. In fact, it is envisioned that the invention herein may well be used with so called subscriber services. These are games where a subscriber pays the fees involved and not the participant. The participant merely pays the subscriber organization a regular fee, be it monthly, yearly or one-time fee or the like. The subscriber may then put on his own tournaments and all of his subscribers are automatically invited, for example.

BRIEF DESCRIPTION OF DRAWINGS

Embodiments of the disclosure will become more fully understood from the detailed description and the accompanying drawings, wherein.

DETAILED DESCRIPTION OF THE INVENTION

The description set forth below in connection with the appended drawings is intended as a detailed description of presently known, exemplary embodiments of the disclosure and is not intended to represent the only forms in which the present invention can, may or could be constructed and/or utilized. The detailed description sets forth the functions and the sequence of the steps for constructing and operating the disclosure in connection with the illustrated embodiments as well as the best mode of carrying out the invention. It is to be understood, however, that the same or equivalent functions and sequences can be accomplished by different exemplary embodiments that are also intended to be encompassed within the spirit and scope of this invention.

The present system and method provides an online video gaming tournament. The present system and method utilizing the hundreds and thousands or even millions of existing multi-player garners and creates tournaments around them where not only are the players competing indirectly against other players in other regions and countries, but the players can also directly compete against other players while in the same game server on opposite teams or even on the same team. Players may not get eliminated horn a tournament and continue to play until the tournament expires. The present system and method may provide two types of tournaments, non-entry-fee tournaments and entry-free tournaments. Sometimes a subscriber service offers free tournaments that are put on by a particular subscriber service. These, too, are covered within the spirit and scope of the invention.

Figure 1:
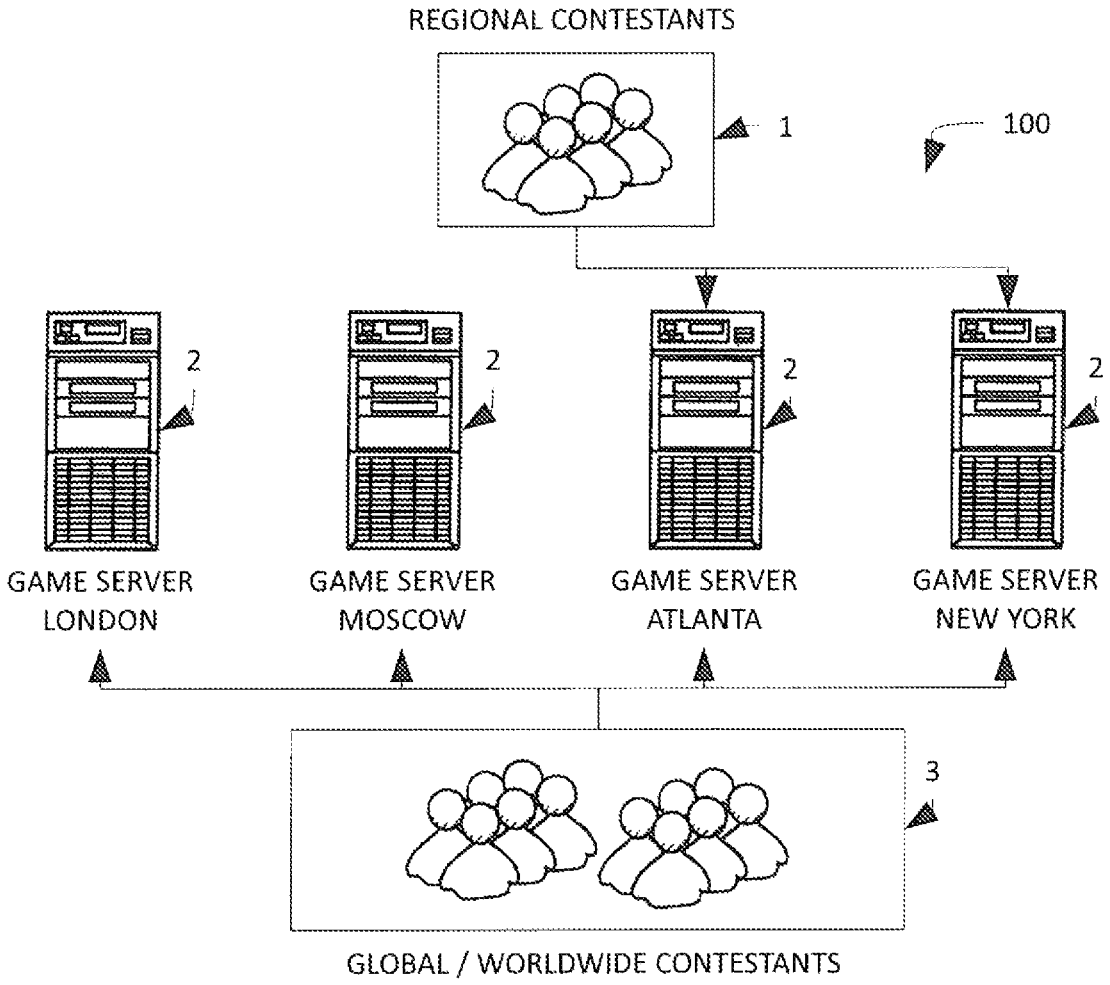
FIG. 1 is a simple block diagram of a system for playing Global and Regional Online Gaming Tournaments.

Referring to FIG. 1, the exemplary embodiment of the invention, the system, is illustrated in schematic and generally denoted by the numeral 100. The system 100 includes a plurality of game servers 2. The servers 2 are divided based upon certain criteria. As shown in FIG. 1, the servers 2 may be divided based on geographic location/region. However, other criteria are possible and such is not meant as limiting the disclosure of the invention in any way. The system 100 includes both regional contestants 1 who may wish to play in a regional online gaming tournament as well as global contestants 3 who may wish to play in a global online gaining tournament. The system 100 may allow regional contestants 1 and global contestants 3 to have the option to enter both global and regional online gaming Tournaments. Alternatively, within the spirit and scope of the invention, the system 100 may only include regional or exclusively include global tournaments. There may even be servers dedicated to particular game manufacturers or a particular category of games. In system 100, the tournaments are played on the same game servers 2, at the same time, but displayed on separate grids as will be more fully appreciated below. Thus, players can join a server 2 in Atlanta and participate in a global and regional online gaming tournament because a player's performance statistics can be used in each online gaming tournament individually. In the system 100, a contestants' performance statistics is calculated and compared against the other online gaming tournament contestants 1 or 3 and that calculation may be used to determine the player's grid ranking and their price winnings.

The system 100, in the exemplary embodiment shown, uses servers 2 which are public servers. By having public gaming servers, the system 100 allows contestants 1 or 3 of the online gaming tournaments to play with non-tournament participants. This allows online gaming tournament contestants 1 or 3 to earn game statistics regardless of the amount of actual tournament participants. The use of public servers in the exemplary embodiment is not meant to be limiting of the invention. Within the spirit and scope of the invention, the system 100 uses private servers, semi-private servers and any other possible server, presently known or to be invented and discovered that would accomplish the purposes herein.

Figure 2:
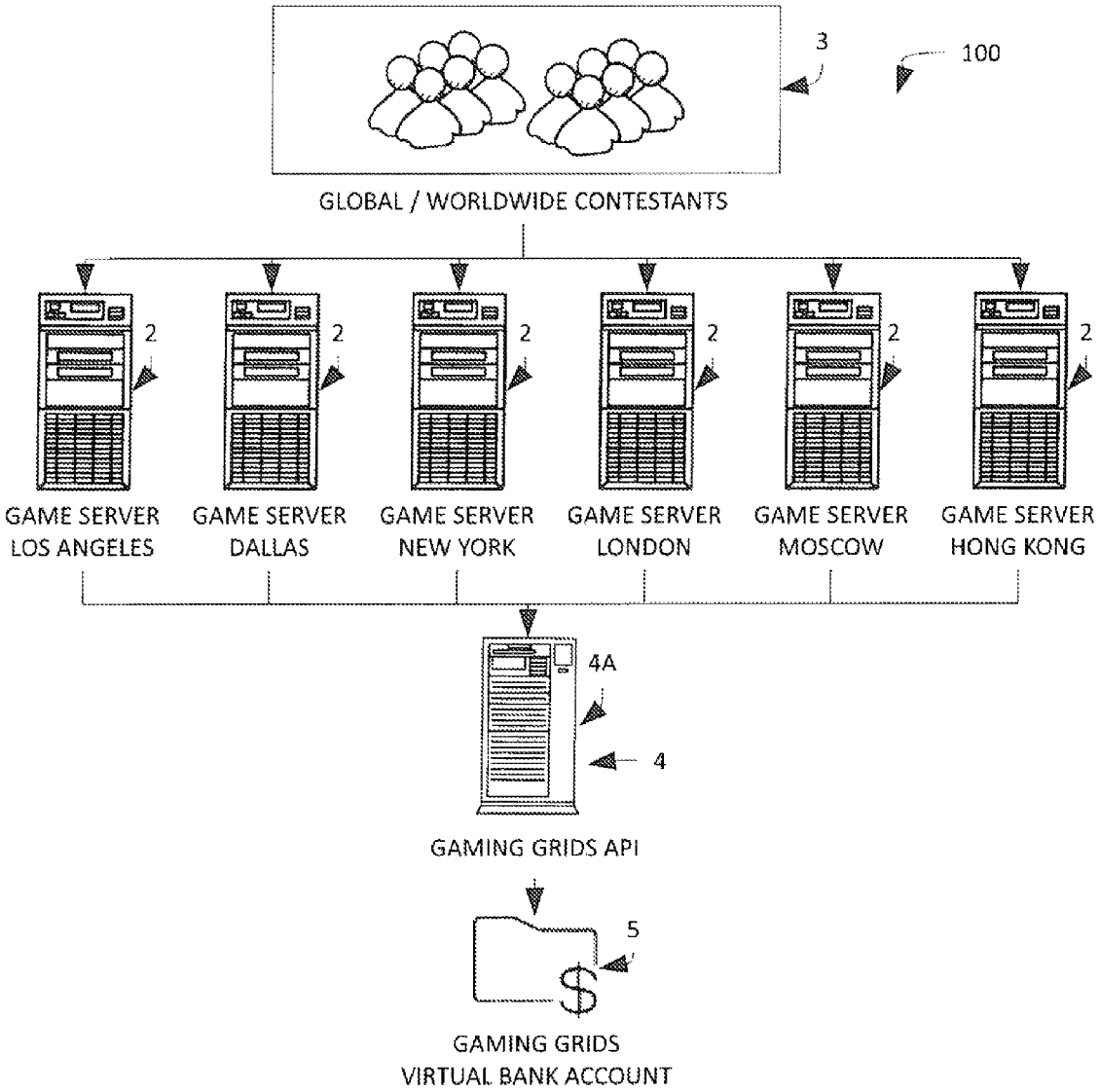
FIG. 2 a simple block diagram of the system showing how players can play in the Global Online Gaming Tournaments.

Referring now to FIG. 2 a global tournament is described in detail. For a global tournament, global contestants 3 are able to access one or more gaming servers 2. In the exemplary embodiment shown in FIG. 2, the gaming servers 2 are coupled to an application programming interface (API) 4. The API 4 is used to calculate statistics related to the game being played on the servers 2. Global tournaments include gathering performance statistics for the global contestant 3 from all the game servers 2 around the world, from a given game and game type, and compiling then into a single ranking system determined by the API 4 to be displayed on the grid. For example, Player "A" located in Los Angeles Calif., USA can indirectly compete against Player "B" located in London, England, UK without directly playing against one another.

In a Global tournament, the global contestants 3 generally pay an entry-fee. As shown in the exemplary embodiment of FIG. 2, the entry fee is taken from a player's bank account 5. The player's bank account 5 includes any type of account set-up by the player, be it real, brick and mortar store or virtual. The player's bank account 5 does not have to be an actual bank account but may be an online gaming account, virtual game account, a Paypal account, or the like. Once an entry fee has been paid from the player's bank account 5, the global contestants 3 may be directed to an official server list of games on the game servers 2 located around the world.

The global contestants 3 may then play on one or multiple official game servers 2 to obtain performance statistics. Those statistics may be calculated by the API 4 and that may be used to determine a global contestants 3 ranking and consequently their winnings. Once determined, the API 4 may transfer the winnings to the player's bank account 5 of the global contestants 3.

Figure 3:
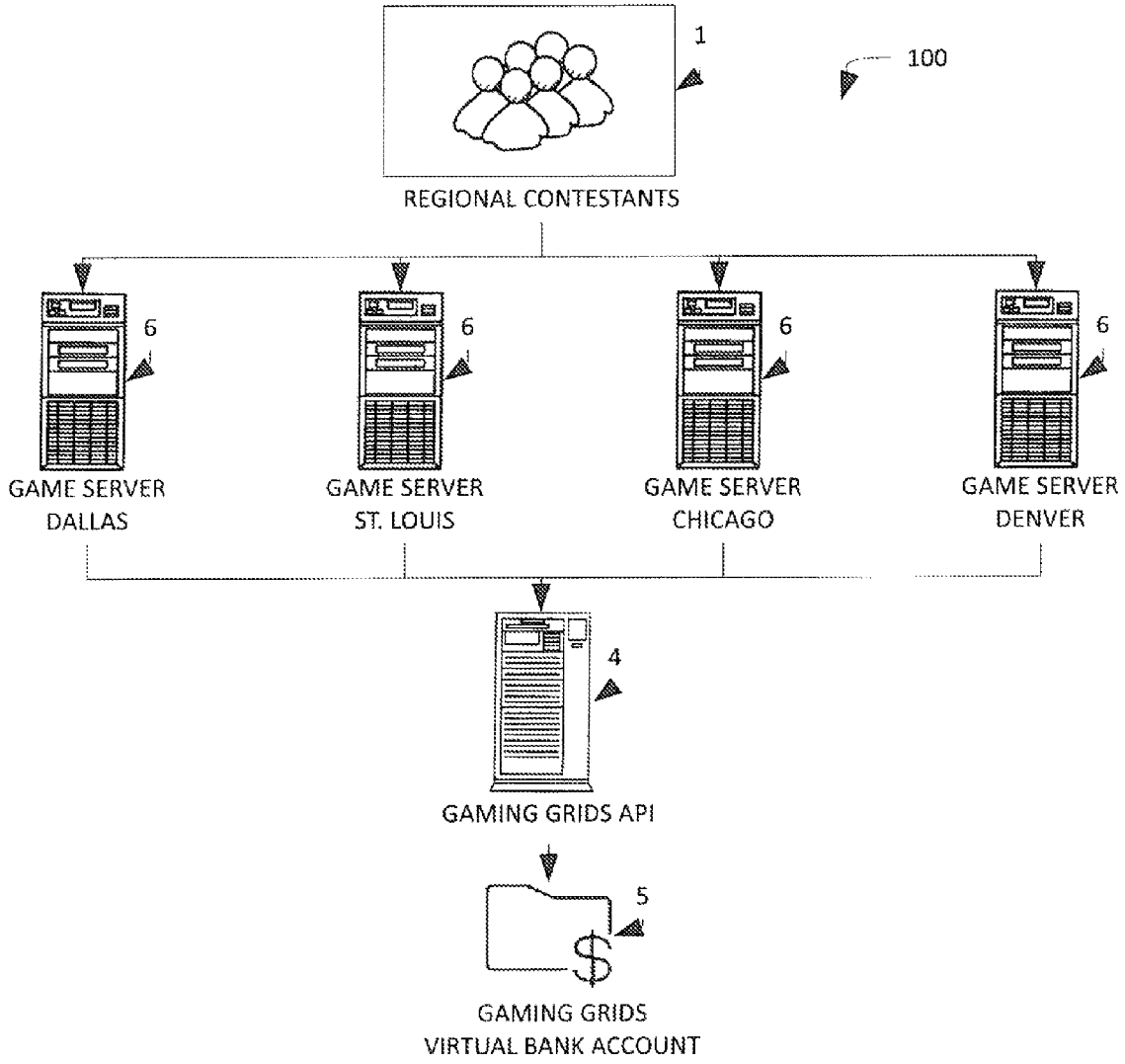
FIG. 3 a simple block diagram of the system showing how players can play in the Regional Online Gaming Tournaments.

As illustrated in FIG. 3, a regional tournament will be described in more detail. For a regional tournament, regional contestants 1 access one or more regional gaming servers 6. The regional tournament consists of gathering performance statistics from specific regional game servers 6 in a given geographical location, such as United States West, specific states in the United States, or United Kingdom and compiling them via the API 4 into a single ranking system to be displayed on the Grid. Player "A" located in Los Angeles, Calif., USA, can indirectly or directly compete with another player in the same region, such as Seattle, Wash., USA.

In a regional tournament, a regional contestant 1 may be required to pay an entry-fee. The entry fee may be taken from a player's bank account 5. The player's bank account 5 may be any type of account set-up by the regional contestants 1. The player's bank account 5 does not have to be an actual bank account but may be an online gaming account, virtual game account, a Paypal account, or the like. Once an entry fee has been paid from the player's bank account 5, the regional contestants 1 may be directed to an official server list on the regional game servers 6 located within a specific region. In this example, this regional online gaming tournament is taking place across Central United States. The player may then play in one or multiple official regional game servers 6 within a region to obtain performance statistics. Those statistics may be calculated and compared against other regional contestants 1 through the API 4 and may be used to determine a regional contestants 1 ranking and consequently their winnings. Once determined, the API 4 may transfer the winnings to the player's bank account 5.

For a paid regional tournament or a paid global tournament, all contestants 1 or 3 pay an entry fee to enter a tournament. After paying the entry-fee, the contestants 1 or 3 are presented with an official server list in which those players play in order to qualify for the tournament and become eligible for rewards. The entry fees are used to establish a tournament pool in one exemplary embodiment. A percentage of the money from entry-fees may be collected and distributed from and to players. Once the tournament has expired, the contestants 1 or 3 may receive their winnings based on their statistical game performance. All funds may be distributed and contained within a player's bank account 5 until the contestants 1 or 3 submit a withdrawal request.

Figure 4:
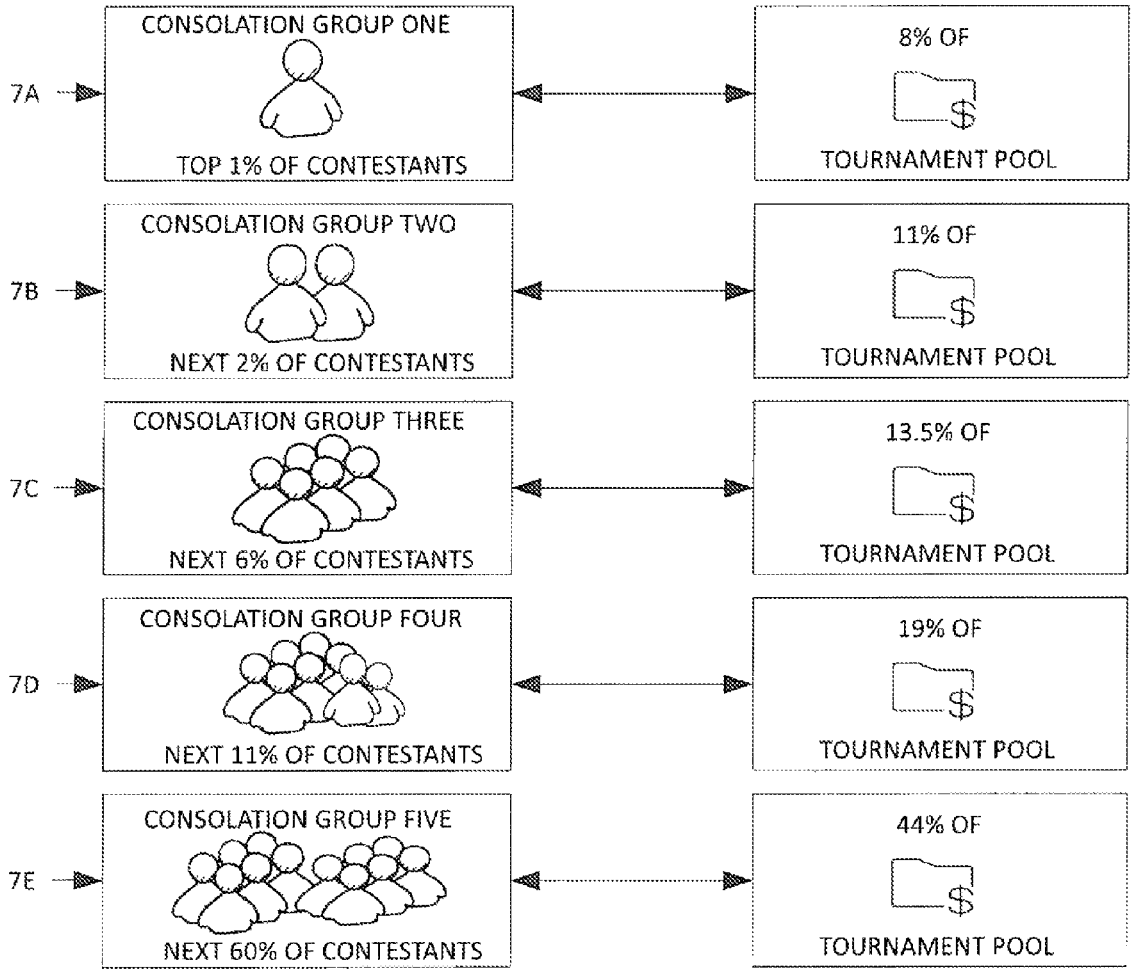
FIG. 4 shows an example of one embodiment of a pay table used in the system of the present invention.

Referring now to FIG. 4, description of one embodiment of a tournament pay table will be disclosed. In accordance with one embodiment, approximately sixty percent of all tournament players may receive winnings with an approximate eighty-five to ninety-five percent game return. There may be a range of consolation groups from one to one hundred that may be paid out. Each consolation group may be populated by a percentage of the winning players.

As may be seen in the embodiment shown in FIG. 4, Consolation Group One 7A may contain the top one percent of all paid contestants 1 or 3 participating in a tournament (i.e., paid regional tournament or a paid global tournament) and may split eight percent (8%) of the Tournament Pool; Consolation Group Two 7B may contain the next top two percent of all paid contestants 1 or 3 participating in the paid tournament (i.e., paid regional tournament or a paid global tournament) and may split eleven percent (11%) of the Tournament Pool; Consolation Group Three 7C may contain the next top six percent of all paid contestants 1 or 3 participating in the paid tournament (i.e., paid regional tournament or a paid global tournament) and may split thirteen and one-half percent (13.5%) of the Tournament Pool; Consolation Group Four 7D may contain the next top eleven percent of all paid contestants 1 or 3 participating in the paid tournament (i.e., paid regional tournament or a paid global tournament) and may split nineteen percent (19%) of the Tournament Pool; Consolation Group Five 7E may contain the next top forty percent of all paid contestants 1 or 3 participating in the paid tournament (i.e., paid regional tournament or a paid global tournament) and may split forty-four percent (44%) of the Tournament Pool. This embodiment is not meant to be limiting, it's merely descriptive of one embodiment. There could of course be more or less than five groups, different monetary percentages for each group and different percentages for the number of players being paid in each group without departing from the spirit and scope of the present invention.

The system 100 allows progressive jackpots. Progressive jackpots in the gambling industry are generally based on a predetermined winning combination(s) that is generally difficult to obtain and all having an element of chance. In video game tournaments, chance is not allowed or it may be considered to be gambling which is currently illegal in all jurisdictions in the United States and most Countries. These tournaments (i.e., paid regional tournament or a paid global tournament) are generally based entirely on skill based achievements. The progressive jackpots are also be based on skill based achievements or combinations of skill sets or sequential skills or skill sets. For example, being the first person to win a predetermined winning combination(s) of skill based achievements could be a first progressive jackpot based on non-gambling scenarios. The above is given as an example and should not be seen in a limiting manner.

Figure 5:
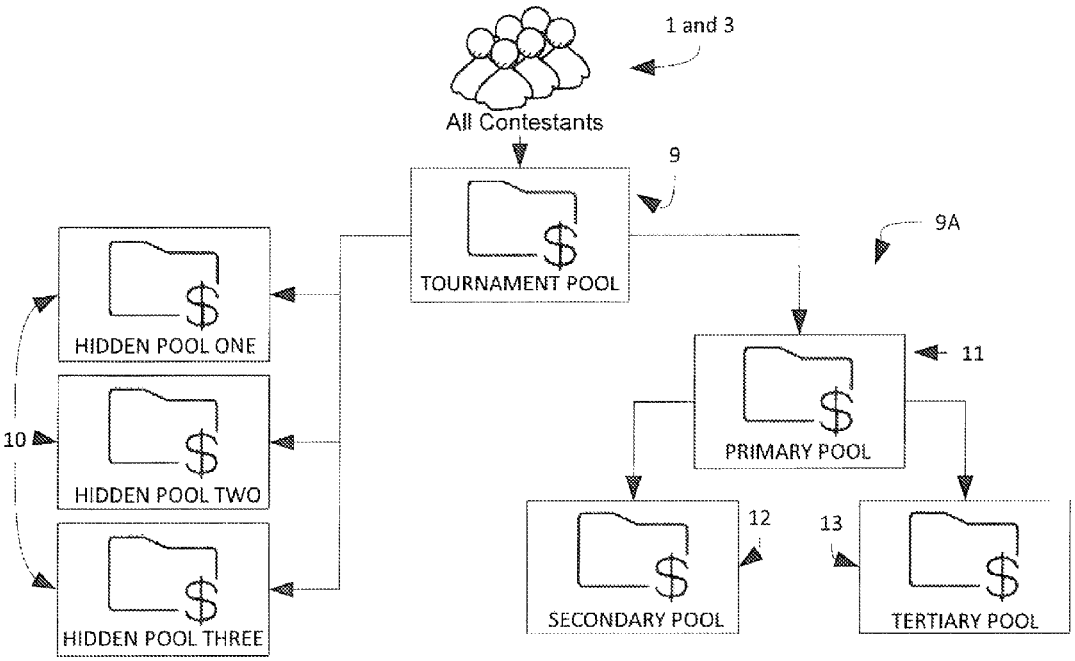
FIG. 5 shows an example of one embodiment of distribution of the tournament pool for the system of the present invention.

Referring now to FIG. 5, there is shown a block diagram schematic illustrating an exemplary embodiment of the tournament pool 9 distribution. In this embodiment, the contestants 1 or 3 in the paid regional tournament or a paid global tournament pay the entry fee to participate. The entry fee may be placed into a tournament pool 9. In this embodiment, a small percent of every tournament pool 9 is reserved and divided between a plurality of progressive tournament pools 9A. In the exemplary embodiment of FIG. 5, three progressive tournament pools 9A (Primary Pool 11, Secondary Pool 12 and Tertiary Pool 13) are visible and obtainable by tournament players and there are hidden tournament pools 10, which are created to replenish the Primary Pool 11 once it has been paid out or hit. A percentage of the Primary Pool 11 may be reserved for the Secondary Pool 12 and the Tertiary Pool 13. The above is only shown as an exemplary embodiment. There may be more or less Progressive Tournament pools 9A as well as different means for allocating distribution of the rewards without departing from the spirit and scope of the present invention.

It accordance with another embodiment of the present invention, the Secondary Pool 12 and Tertiary Pool 13 pools may have Hidden Pools 10.

Progressive tournament pools 9A may be won in different manners. For example, to win the Tertiary Pool 13, a paid player: Places third or better four times in the same game and tournament type. In accordance with one exemplary embodiment, the Secondary Pool 12 may be awarded after the Tertiary Pool 13 has been won. Once the Tertiary Pool 13 has been won, to in for the Secondary Pool 12, a paid player may have to Place in second or better three times in the same game and tournament type. In accordance with one exemplary embodiment, once the Tertiary Pool 13 and Secondary Pool 12 have been won, to qualify for the Primary Pool 11 a contestant may have to: Place in first two times in the same type of tournament for the same game. The above are only given as examples and should not be seen in a limiting, manner.

Figure 6:
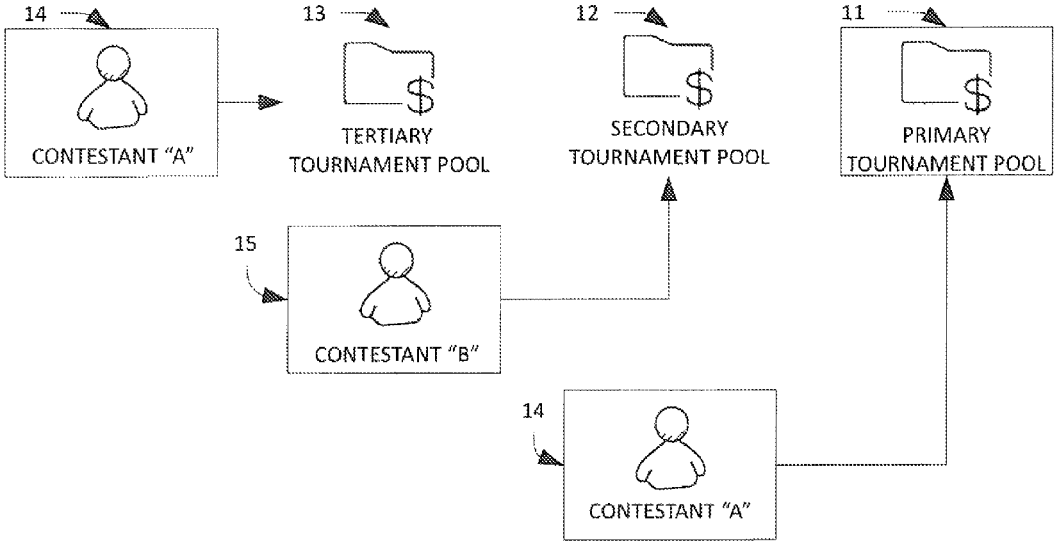
FIG. 6 shows an example of one embodiment of distribution of a progressive jackpot for the system of the present invention.
Figure 7:
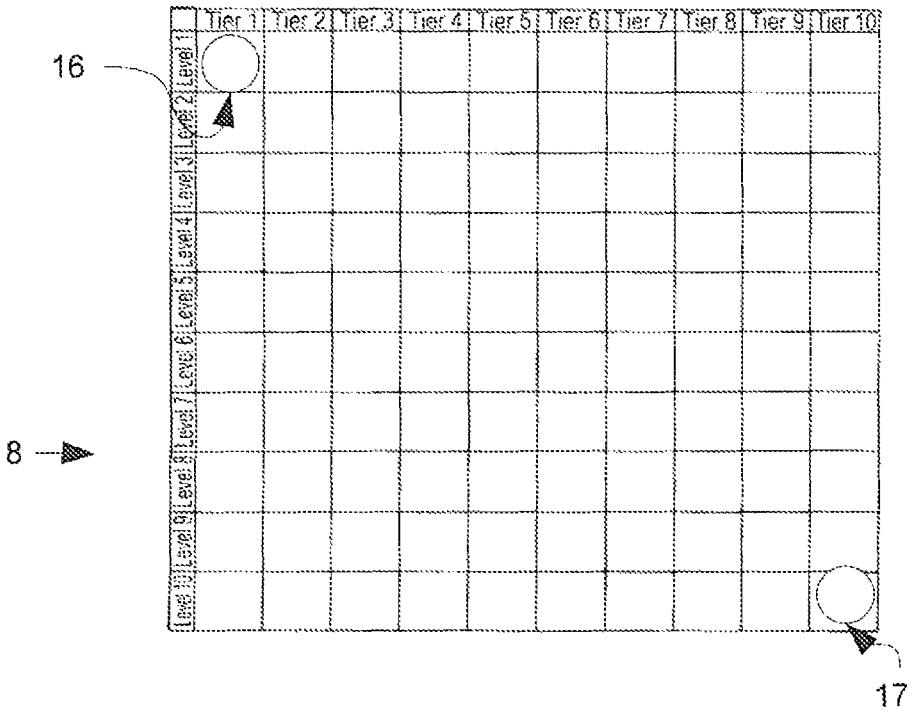
FIG. 7 shows an example of a player ranking grid used in the system of the present invention.
Figure 8:
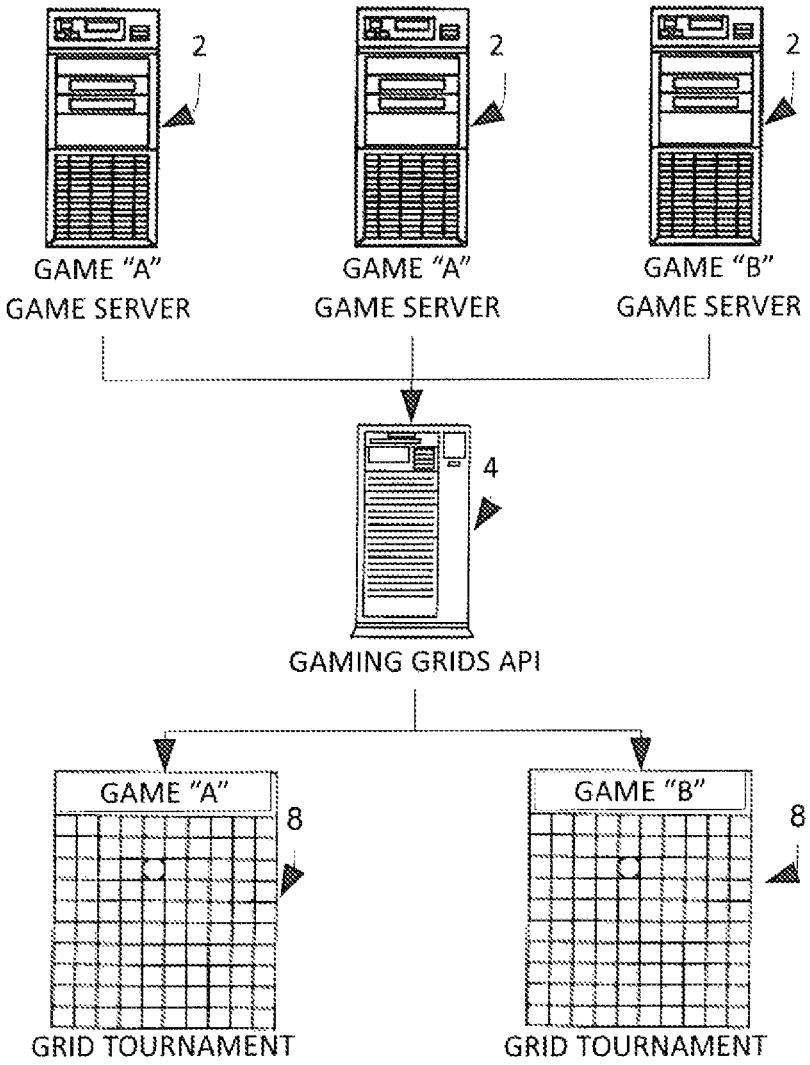
FIG. 8 shows an example of how the API of the present system generates a player ranking grid for different online gaming tournaments.

Referring to FIG. 6, there is shown an exemplary embodiment of the tournament pool distribution. In FIG. 6, a Contestant "A" 14 from one of the paid regional tournaments or paid global tournaments wins the Tertiary Pool 13. Then Contestant "B" 15 may win the Secondary Pool 12, only after the Tertiary Pool 13 has been hit. Then any contestant can win the Primary Pool 11, but only after the Tertiary Pool 13 and Secondary Pool 12 have been hit.

In the event that the Primary Pool 11 is won, Hidden Pools 10 are allocated. For example, Hidden Pool 1, in one exemplary embodiment, is allocated to the Primary Pool 11, Hidden Pool 2 is allocated to Hidden Pool 1 and Hidden Pool 3 is depleted to zero. This may be used to help prevent the Primary Pool 11 from starting at an, insignificant dollar amount. This progressive embodiment is not meant to be limiting, its merely descriptive of one exemplary embodiment. In-Game skills and skill sets could also be used in competing scenarios to form progressive jackpots.

In an exemplary embodiment of the system 100, the API 4 is stored on a server 4A within the system 100 in accordance with one or more exemplary embodiments of the present invention. The server can take the form of a computer server, and more specifically a web server. The server 4A can include ROM, operating system and software instructions, RAM, central processor unit (CPU), network interface to connect the server storing the API 4 to the gaming servers 2 and a data storage device. A conventional personal computer or computer workstation with sufficient memory and processing capabilities can be used as the server 4A. Alternatively, multiple interconnected servers can also serve as the server.

Figure 9:
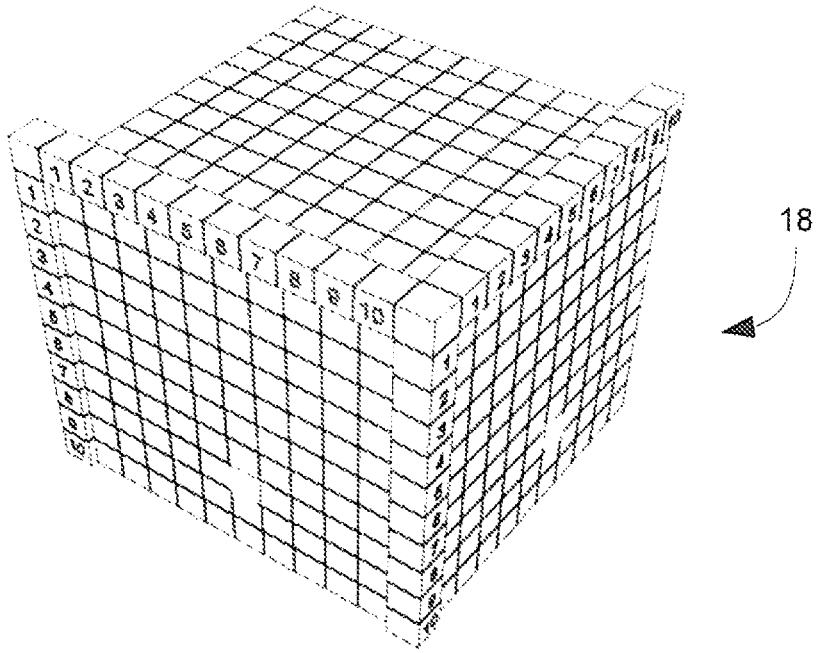
FIG. 9 shows one example of the make-up of a player ranking cube used in the system of the present invention.
Figure 9:
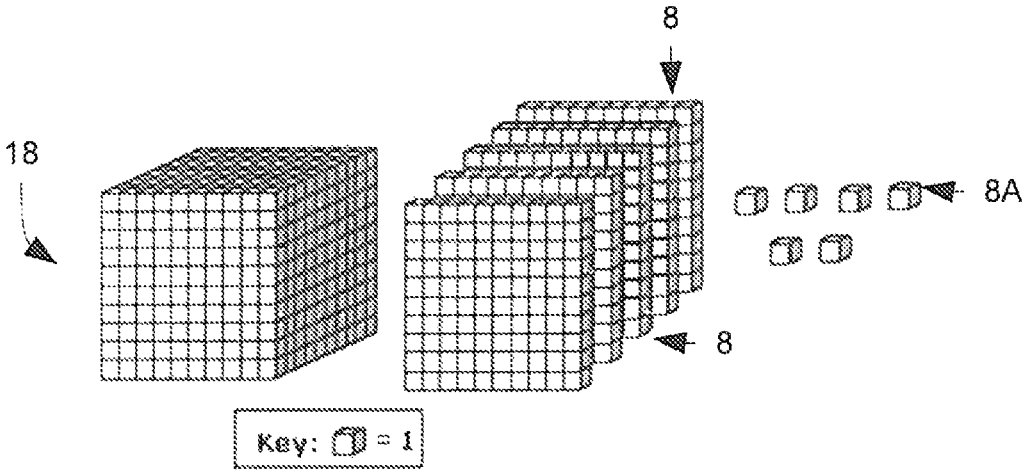
Figure 10:
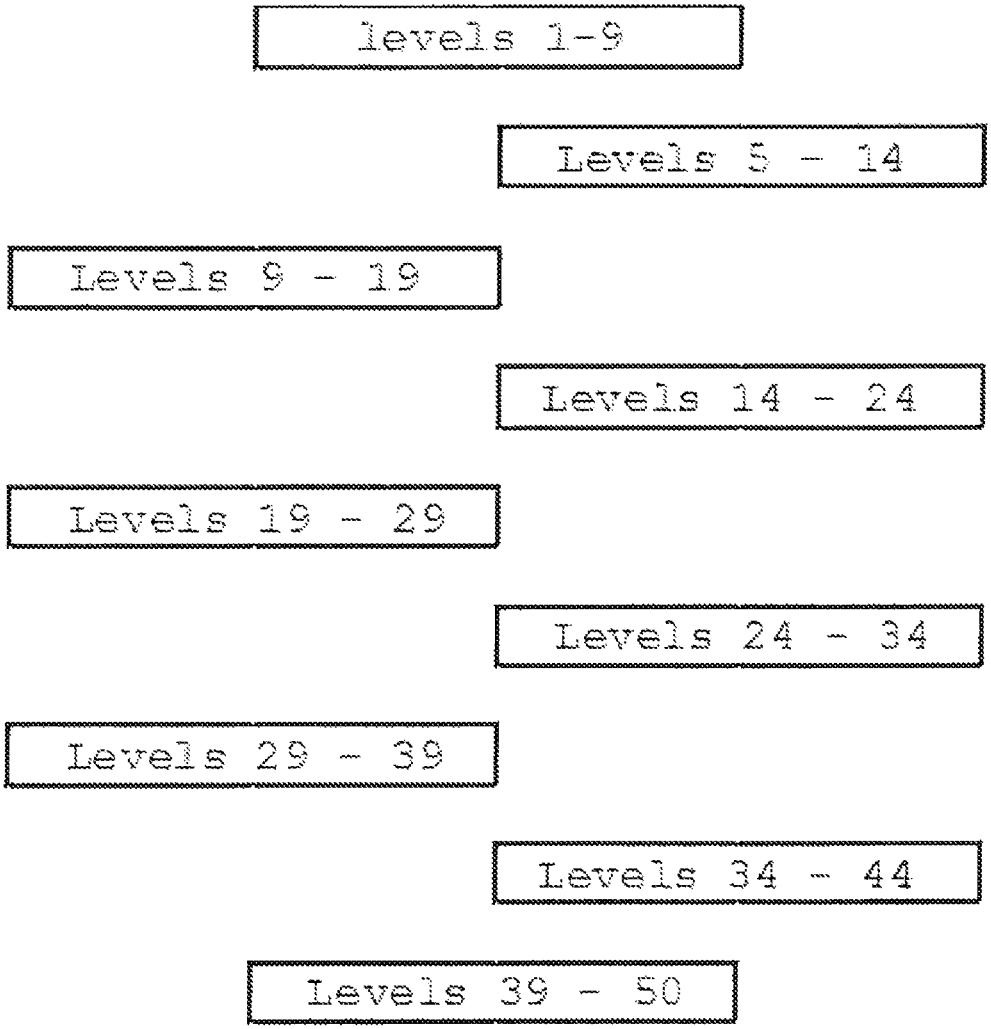
FIG. 10 shows one example of the make-up of a player ranking cube used in the system of the present invention.

In another exemplary embodiment using the cube 18 of FIG. 9, the API 4 factors into the ranking, the player's or team's performance in-game and skill ranking differential between the two players (or teams) in determining actual grid movement during and after a match and a player's or team's post-match ranking. Skill ranking and new skills are earned during a match and those skills are updated during the match and reflected in the cube 18. Post-match performance algorithms assign a percentage of the losing players skill ranking to the winning player: or declares an in-game performance score multiplier; which effectively transfers skill rating from a losing player to a winning player, or rewards a winning player with additional skill ranking/rating points based on an outcome with a higher-ranked player, in addition to any already calculated performance data from the match game statistics.

Referring now to FIGS. 7-10, there is illustrated an exemplary embodiment of the grid 8. In this embodiment, the API 4 generates a ranking grid 8. The grid 8 is a unique multi-level, multi-tier grid. In accordance with this embodiment, the grid 8 has 100 positions (10 levels with 10 tiers) player ranking grid per tournament, per game.

The grid 8 is used for rating and ranking players skill based on live and real-time or past performance within the given game and/or tournament; by means of skill rating algorithms and mathematics that are processed during and after each tournament match. The higher of a players skill, the higher they are visually seen, and programmatically ranked on the grid 8 (high being towards upper-left, L1T1—Level 1, 16, Tier 1 as may be seen in FIG. 7).

The grid 8 has the ability to function in a dynamic mode, enabling the Level 1, Tier 1 position to have a minimum numerical skill ranking equal to that of the highest ranked player; and then allow for an exponential decrease in minimum/maximums required per each level/tier combination until the bottom (level 10, tier 10, 17) is reached—which in most cases is at 0.

During a tournament, players may join via one of two methods; (1) manually by using a user interface of a website, mobile applications, or other deemed user interface applications, or (2) automatically by having enabled an Auto-Join Feature, which may intelligently join a user to a tournament based on defined and agreed upon criteria once the system detects that the player is playing in a sanctioned tournament server (location).

Players may play throughout the tournament within one or multiple Game Servers 2 (locations); from this point, the system 100 may "handshake" with the game server 2 and pull real-time or near real-time game play performance and commit to the grid 8 via use of the API 4; exposing public-facing methods to allow for on-demand grid calculation algorithmic processing for player performance data obtained within the aforementioned server(s) 2.

Once player performance data has been fed from the game server(s) 2 of the tournament(s), the API 4 processes gamer performance into numerical rating and ranking "scores" which are then plotted on the appropriate tournament grid(s) 8; from this point, once a tournament has expired or otherwise completed based on the allotted play-time, the system 100 calculates player positions, rewards, and progressive jackpot (s)/tournament pool(s) issuance based on the player rating/ranking as demonstrated per the placement on the actual tournament gaming "grid" 8. The grid 8 has the ultimate responsibility of determining player skill ranking within the game, and determining what player(s) get rewarded, as well as visually showing to players, users, and bystanders the progress and performance of players within.

The system 100 may operate a unique 100 position (10 levels with 10 tiers) player ranking grid 8 per tournament, per game. The grid 8 is responsible for rating and ranking players skill based on live and real-time or past performance within the given game and/or tournament; by means of unique skill rating algorithms and mathematics that are processed during and after each tournament match. The higher of a player skill, the higher they are visually seen, and programmatically ranked on the grid (high being towards upper-left, L1T1—Level 1, Tier 1, 16).

The grid 8 has the ability to function in a dynamic mode, enabling the Level 1, Tier 1 position 16 to have a minimum numerical skill ranking equal to that of the highest ranked player; and then allow for an exponential decrease in minimum/maximums required per each level/tier combination until the bottom (level 10, tier 10, 17) is reached—which in most cases is at 0.

Players may play throughout the tournament within one or multiple sanctioned Game Servers 2 (locations) i.e Game Server 2 running Game "A" or Game Server 2 running Game "B"; from this point, the system 100 may "handshake" with the game servers 2 and pull real-time or near real-time game play performance and commit to the grid 8 via use of the API 4; exposing public-facing methods to allow for on-demand grid calculation algorithmic processing for player performance data obtained within the aforementioned server(s) 2.

Once player performance data has been fed from the game server(s) 2 of the tournament(s), the system 100 processes gamer performance into numerical rating and ranking "scores" which may then be plotted on the appropriate tournament grid(s) 8 i.e Grid for Game "A" or Grid for Game "B"; from this point, once a tournament has expired or otherwise completed based on the allotted play-time, the system 100 may calculate player positions, rewards, and progressive jackpot(s)/tournament pool(s) issuance based on the player rating/ranking as demonstrated per the placement on the actual tournament gaming grid 8. The grid 8 has the ultimate responsibility of determining player skill ranking within the game, and determining what player(s) get rewarded, as well as visually showing to players, users, and bystanders the progress and performance of players within.

The system 100 may be expanded to so that the grid technology can incorporate millions of players that will be playing from around the world. The grids 8 may be configured into a 3-Dimensional Cube 18 as shown in FIG. 9, which can have a multitude of functions. i.e. player ratings, types of games, amounts of the various progressive prizes or any other functions of the games that need and/or players want displaying. In addition to ranking players, a portion of the 3-Dimensional Cube 18, may, in an exemplary embodiment, be dedicated to ranking the game itself, comparing the instant game to other games on the 3-Dimensional Cube 18. Since the 3-Dimensional Cube 18 is capable of serving many games, the various games may be compared to one another and ranked against one another.

As illustrated in exemplary embodiment of the 3-Dimensional Cube 18 of FIG. 9, the cube 18 includes a plurality of stacked grids 8. The stacked grids 8 having a plurality of levels and each level having a plurality of tiers 8A In the exemplary embodiment of the 3-Dimensional Cube 18 in FIG. 9, the cube 18 gives the tournament the functionality and the flexibility to allow players of multiple level skills to compete against one another on a generally level playing field. As a player progresses through the game's skill levels and acquires new skills, the player receives increasingly greater challenges. However, as a result of using the ranking functionality of the 3-Dimensional Cube 18, players mostly compete against players of equal Or lesser skill levels, for example, within 5 to 10 level range based on Cube schema 1 or Cube schema 2.

Cube Schema 1, Functional Description

With particular reference to FIG. 9, there is illustrated an exemplary embodiment of the 3-dimensional cube 18. In the embodiment illustrated, the 3-dimensional cube 18 includes a plurality of stacked grid levels resulting in a minimum and maximum of 10 levels of difference in the player skill during play on that level of the cube section. As the player progresses to the next cube level, 10 in-game experience levels are earned prior to attaining the next cube level. This repeats itself until a player goes as far as possible based upon the player's skill level.

Cube Schema 2 Functional Explanation

Interlaced and offset cube level layers (FIG. 10) produce a fixed effect for the player as the player enters the next cube level at the middle of the skill levels thus having a + or −5 level difference in actual skill as the player proceeds through the cube levels. The same format pertains to this cube level as in Schema 2. As the player progresses to the next cube level, 10 in-game experience levels are earned. These levels must be earned prior to attaining the next cube level. This repeats itself until a player goes as far as possible based upon the player's skill level.

While embodiments of the disclosure have been described in terms of various specific embodiments, those skilled in the art will recognize that the embodiments of the disclosure may be practiced with modifications within the spirit and scope of the claims.

What is claimed is:

1. A video gaming system having plurality of video gaming servers for hosting online video gaming tournaments, the system comprising:

a statistical server having an application programming interface, the application programming interface configured to automatically calculate performance statistics relating to a game being played on the video gaming servers;

the statistical server coupled to the plurality of video gaming servers having a processor for executing program instructions and a memory coupled to the processor for storing the program instructions, the programming instructions comprising:

establishing at least one online video gaming tournament;

accepting by the statistical server entry of a plurality of participants into the online video gaming tournament;

accepting of an entry fee by each of the plurality of participants in the online video gaming tournament;

establishing by the application programming interface a dynamic participant ranking grid, the dynamic participant ranking grid updating based on performance of each participant of the plurality of participants in-game, wherein a position of individual participants of the plurality of participants on the dynamic participant ranking grid moves during and after the online video gaming tournament;

establishing a tournament pool, which includes a reward system and wherein a percentage of the rewards are distributed as winnings;

establishing a consolation prize system to pay non-winning participants a percentage of monies from the entry fee collected;

establishing at least one progressive jackpot; and distributing by the application programming interface the winnings upon the completion of the video gaming tournament.

2. The video gaming system of claim 1, wherein the dynamic participant ranking grid is a multi-level, multi-tier dynamic participant ranking grid.

3. The video gaming system of claim 1, wherein performance of the participant in-game and skill ranking differential between at least two participants determine movement on the dynamic participant ranking grid.

4. The video gaming system of claim 3, wherein the dynamic participant ranking grid defines a 3 dimensional cube.

5. The video gaming system of claim 3, wherein a percentage of a losing participant skill ranking is given to a winning participant or an in-game performance score multiplier.

6. The video gaming system of claim 1, wherein the program instructions further comprises establishing virtual participant bank accounts, payment of winnings distributed by the application programming interface and contained within the virtual participant bank account of the winning participants.

7. The video gaming system of claim 1, wherein the at least one progressive jackpot is awarded based on skill based on one of: achievements in the online video gaming tournament or combinations of skill sets or sequential skills or skill sets performed in the online video gaming tournament.

8. The video gaming system of claim 1, wherein the program instructions further comprises establishing a plurality of progressive jackpots, wherein the plurality of progressive jackpots comprises a plurality of visible progressive jackpots and a plurality of hidden progressive jackpots.

9. The video gaming system of claim 8, wherein the plurality of visible progressive jackpots comprises at least a secondary pool and a primary pool.

10. The video gaming system of claim 8, wherein the plurality of hidden progressive jackpots comprises:

a first hidden pool allocated to replace the primary pool; and a second hidden pool allocated to replace the first hidden pool.

11. The video gaming system of claim 1, wherein establishing at least one online video gaming tournament further comprises:

establishing at least one global online video gaming tournament; and establishing at least one regional online video gaming tournament.

12. The video gaming system of claim 1, wherein the participants do not pay a fee for joining the tournament, but rather pay a subscription service for free tournaments.

13. The video gaming system of claim 1, wherein the participants join a non-fee tournament.

14. The online video gaming tournament system of claim 1, wherein the program instructions further comprises automatically joining the at least one online video gaming tournament based on predefined criteria.

15. An online video gaming tournament system comprising:

a plurality of video gaming servers for hosting a plurality of online video gaming tournaments, wherein the plurality of online video gaming tournaments comprises:

at least one global online video gaming tournament; and at least one regional online video gaming tournament;

a statistical server having an application programming interface, the application programming interface configured to automatically calculate performance statistics relating to a game being played on the video gaming servers;

the statistical server coupled to the plurality of video gaming servers having a processor for executing program instructions and a memory coupled to the processor for storing the program instructions, the programming instructions comprising:

accepting by the statistical server entry of a plurality of participants into the online video gaming tournament;

establishing a tournament pool, which includes a reward system and wherein a percentage of the rewards are distributed as winnings;

establishing by the application programming interface a dynamic participant ranking grid, the dynamic participant ranking grid updating based on performance of each participant of the plurality of participants in-game, wherein a position of individual participants of the plurality of participants on the dynamic participant ranking grid moves during and after the online video gaming tournaments, wherein performance of the participant in-game and skill ranking differential between two participants determine movement on the dynamic participant ranking grid;

establishing at least one progressive jackpot; and distributing by the application programming interface the winnings upon the completion of the video gaming tournament.

16. The online video gaming tournament system of claim 15, wherein the dynamic participant ranking grid is a multi-level, multi-tier dynamic participant ranking grid.

17. The online video gaming tournament system of claim 15, wherein a percentage of a losing participant skill ranking is given to a winning participant or an in-game performance score multiplier.

18. The online video gaming tournament system of claim 15, wherein the program instructions further comprise establishing virtual participant bank accounts, payment of winnings distributed by the application programming interface and contained within the virtual participant bank account of the winning participants.

19. The online video gaming tournament system of claim 15, wherein the at least one progressive jackpot is awarded based on skill based achievements.

20. The online video gaming tournament system of claim 19, wherein the program instructions further comprises establishing a plurality of progressive jackpots, wherein the plurality of progressive jackpots comprises a plurality of visible progressive jackpots and a plurality of hidden progressive jackpots.

21. The online video gaming tournament system of claim 20, wherein the plurality of visible progressive jackpots comprises at least a secondary pool and a primary pool.

22. The video gaming system of claim 15, wherein the participants each pay a fee for joining the tournament, thereby defining a fee tournament.

23. An online video gaming tournament system comprising:

a plurality of video gaming servers for hosting a plurality of online video gaming tournaments, wherein the plurality of online video gaming tournaments comprises:

at least one global online video gaming tournament; and at least one regional online video gaming tournament;

a statistical server having an application programming interface, the application programming interface configured to automatically calculate performance statistics relating to a game being played on the video gaming servers;

the statistical server coupled to the plurality of video gaming servers having a processor for executing program instructions and a memory coupled to the processor for storing the program instructions, the programming instructions comprising:

accepting by the statistical server entry of a plurality of participants into the online video gaming tournament;

accepting of a fee paid by each of the plurality of participants in the online video gaming tournament;

establishing a tournament pool, wherein a percentage of monies from the fee collected is distributed as winnings and a percentage of monies from the fee collected is distributed to predetermined non-winning participants;

establishing by the application programming interface a dynamic participant multi-level, multi-tier ranking grid, the dynamic participant ranking grid updating based on performance of each participant of the plurality of participants in-game, wherein a position of individual participants of the plurality of participants on the dynamic participant ranking grid moves during and after the online video gaming tournaments, wherein performance of the participant in-game and skill ranking differential between at least two participants determine movement on the dynamic participant ranking grid;

establishing virtual participant bank accounts, payment of winnings distributed by the application programming interface and contained within the virtual participant bank account of the winning participants; and payment of winnings after the video gaming tournaments have expired, payment of winnings based on participant's statistical game performance.

24. The online video gaming tournament system of claim 23, wherein the program instructions further comprises establishing a plurality of progressive jackpots, wherein at least one of the plurality of progressive jackpots is awarded based on skill based on one of: achievements in the online video gaming tournament or combinations of skill sets or sequential skills or skill sets performed in the online video gaming tournament.

25. The online video gaming tournament system of claim 24, wherein the plurality of progressive jackpots comprises:

a plurality of visible progressive jackpots, wherein the plurality of visible progressive jackpots comprises:

at least a secondary pool; and a primary pool; and a plurality of hidden progressive jackpots, wherein the plurality of hidden progressive jackpots comprises:

a first hidden pool allocated to replace the primary pool; and a second hidden pool allocated to replace the first hidden pool.

26. The online video gaming tournament system of claim 23, wherein the program instructions further comprises automatically joining one of the plurality of online video gaming tournaments based on predefined criteria.

27. A video gaming system comprising:

a statistical server having an application programming interface, the application programming interface configured to automatically calculate performance statistics relating to a game being played on the video gaming servers;

the statistical server having a processor for executing program instructions and a memory coupled to the processor for storing the program instructions, the programming instructions comprising:

establishing at least one online video gaming tournament;

accepting by the statistical server of entry fees by participants in the online video gaming tournament;

establishing a tournament pool, wherein a percentage of monies from the entry fees collected is distributed by the application programming interface as winnings; and establishing at least one progressive jackpot, the at least one progressive jackpot is awarded based on skill based achievements, the at least one progressive jackpot is awarded based on skill based on one of: achievements in the online video gaming tournament or combinations of skill sets or sequential skills or skill sets performed in the online video gaming tournament.

28. The video gaming system of claim 27, wherein the program instructions further comprises establishing a plurality of progressive jackpots, wherein the plurality of progressive jackpots comprises a plurality of visible progressive jackpots and a plurality of hidden progressive jackpots.

29. The video gaming system of claim 28, wherein the plurality of visible progressive jackpots comprises at least a secondary pool and a primary pool.

30. The video gaming system of claim 29, wherein the plurality of hidden progressive jackpots comprises:

a first hidden pool allocated to replace the primary pool; and a second hidden pool allocated to replace the first hidden pool.

31. A video gaming system comprising:

a statistical server having an application programming interface, the application programming interface configured to automatically calculate performance statistics relating to a game being played on the video gaming servers;

the statistical server having a processor for executing program instructions and a memory coupled to the processor for storing the program instructions, the programming instructions comprising:

establishing at least one online video gaming tournament;

accepting by the statistical server of entry fees by participants in the online video gaming tournament;

establishing a tournament pool, wherein a percentage of monies from the entry fees collected is distributed by the application programming interface as winnings; and establishing a consolation prize system to pay non-winning participants a percentage of monies from the entry fees collected, wherein each consolation prize group is populated by a predetermined percentage of participants and awarded a predetermined percentage of the tournament pool.

32. The video gaming system of claim 31, wherein the program instructions further comprises establishing a plurality of consolation prize groups for the consolation prize system.

33. The video gaming system of claim 31, wherein the program instructions further comprises establishing a plurality of consolation prize groups for the consolation prize system, wherein each consolation prize group is populated by a predetermined percentage of participants.

34. A video gaming system comprising:

a statistical server having an application programming interface, the application programming interface configured to automatically calculate performance statistics relating to a game being played on the video gaming servers;

the statistical server having a processor for executing program instructions and a memory coupled to the processor for storing the program instructions, the programming instructions comprising:

establishing at least one online video gaming tournament;

accepting by the statistical server entry of a plurality of players in the online video gaming tournament;

establishing a tournament pool which distributes rewards, wherein a percentage of rewards are distributed by the application programming interface as winnings;

creating a 3-dimensional cube based on player skill based achievements, the cube storing and ranking players based on the achievements; and comparing the differential ranking and skill level between at least two players competing in a match and determining the actual cube movement during and after a match and determining player post-match ranking.

35. The video gaming system of claim 34, wherein the program instructions specific to the cube include tracking player in-game performance and skill ranking throughout the game and updating player rank and skill level based on in-game performance.

36. The video gaming system of claim 34, wherein the cube includes a post-match performance algorithm, which based upon program instructions selectively does one or more of the following: assigns a percentage of the losing player's skill ranking to the winning player, declares an in-game performance score multiplier, transfers skill rating from a losing player to a winning player, and rewards a winning player with additional skill rating level based on an outcome with a higher-ranked player.

37. The video gaming system of claim 34, wherein the cube includes a plurality of stacked grids, each grid having a plurality of layers and each level having a plurality of tiers.

38. The video gaming system of claim 34, wherein the program instructions specific to the cube include comparing the differential ranking results for the game being played and instructing the cube to rank each game.

* * * * *